US006051514A

United States Patent [19]

Ayama et al.

[11] Patent Number: 6,051,514

[45] Date of Patent: Apr. 18, 2000

[54] SLIDING NOZZLE FILLER

[75] Inventors: Jun Ayama; Akira Ohashi, both of Hyogo; Manabu Tano, Tokyo; Hideto Takasugi, Tokyo; Akira Shirayama, Tokyo; Hirohisa Nakashima, Tokyo, all of Japan

[73] Assignees: Yamakawa Sangyo Co., Ltd., Hyogo; NKK Corporation, Tokyo; Nippon Rotary Nozzle Co., Ltd., Kanagawa, all of Japan

[21] Appl. No.: 09/011,392

[22] PCT Filed: Aug. 8, 1996

[86] PCT No.: PCT/JP96/02257

§ 371 Date: Apr. 7, 1998

§ 102(e) Date: Apr. 7, 1998

[87] PCT Pub. No.: WO97/05978

PCT Pub. Date: Feb. 20, 1997

[30] Foreign Application Priority Data

Aug. 9, 1995 [JP] Japan ..... 7-203514

[51] Int. Cl.[7] ..... C04B 35/12; C04B 35/105; B22D 41/46

[52] U.S. Cl. ..... 501/126; 501/132

[58] Field of Search ..... 501/126, 132

[56] References Cited

U.S. PATENT DOCUMENTS

| | | |
|---|---|---|
| 4,525,463 | 6/1985 | Dislich et al. . |
| 4,928,931 | 5/1990 | Dislich et al. . |
| 5,124,285 | 6/1992 | Dislich . |
| 5,374,593 | 12/1994 | Heard et al. . |

FOREIGN PATENT DOCUMENTS

| | | | |
|---|---|---|---|
| 59-5388 | 1/1979 | Japan | B22D 41/08 |
| 62-244570 | 10/1987 | Japan . | |
| 6057942 | 8/1992 | Japan | B22D 41/08 |
| 6-71424 | 3/1994 | Japan | B22D 41/08 |
| 7-251261 | 10/1995 | Japan | B22D 41/46 |
| 78109973 | 12/1990 | Taiwan . | |

OTHER PUBLICATIONS

Microstructural and morphological changes of silica and chromite packing sands for sliding gate system for steel ladies after heating at temperature—H.C. Pan and Y.C. Ko—Ironmaking and Steelmaking 1992 vol. 19 No. 5 (no month).

*Primary Examiner*—Michael Marcheschi
*Attorney, Agent, or Firm*—Cohen, Pontani, Lieberman & Pavane

[57] ABSTRACT

A filler for a sliding gate containing 70 to 90 wt % of chromite sand and 10 to 30 wt % of silica sand in which the particle size distribution of the chromite sand is substantially from 500 to 1,000 $\mu$m, which is not melted, sintered or penetrated by molten metal (molten steel) poured in a ladle in a steel works, and therefore is easily discharged to let the gate through.

5 Claims, 1 Drawing Sheet

SLIDING NOZZLE FILLER

BACKGROUND OF THE INVENTION

1. Field of the Invention

The present invention relates to a filler for a sliding gate, in particular, a filler for a sliding gate which is not melted, sintered or penetrated by molten metal (molten steel) poured into a ladle in a steel works and therefore is easily discharged to let the molten metal through the gate.

2. Description of Related Art

A ladle receiving molten steel in a steel works is provided with a sliding gate. The ladle with the sliding gate is required to be fed with a filler comprising refractory powder before molten steel is introduced into the ladle, for the purpose of preventing the molten steel from solidifying in the gate.

Conventional fillers, however, sometimes form a sintered layer due to molten steel and block the opening of the gate. Since such blocking prevents the molten steel poured in the ladle from being discharged, workers often have to, for example, pound the filler block with iron rods. Such a work is extremely dangerous and, in view of inhibiting labor accidents, it is highly demanded that the possibility that the blocking does not occur (hereafter referred to as non-blocking ratio) should be brought close to 100%.

In addition, in today's prevailing manufacture facilities for continuous casting, the blocking generated in gates cause a lot of problems in operation. In some cases, after being primarily smelted in a converter, steel is secondarily smelted for deoxygenation, dephosphorization or desulfurization in a ladle for a long time. Certain kinds of steel are held in the ladle in a molten state for as long as about 7 to 8 hours. Therefore, there is demand for a filler for sliding gates capable of withstanding such conditions.

As a filler, silica sand is conventionally used. However, in view of resistance to fire, sand obtained by subjecting refractory natural chrome ore to drying and classification (hereafter referred to as chromite sand) is sometimes used as a filler.

Since the chromite sand tends to sinter and cause the blocking at the casting of molten steel, however, the chromite sand is rarely used independently as a filler. In general, as described in Japanese Patent Publication No. Sho 60(1985)-57942, the chromite sand is disposed to form a lower layer in a sliding gate and the silica sand is disposed to form an upper layer therein.

However, when the silica sand and chromite sand are used in complete separation as described in the above Patent Publication, they sometimes cause the blocking in the sliding gate, which leads to an unsatisfactory non-blocking ratio.

SUMMARY OF THE INVENTION

The inventors of the present invention have been making devoted study, finally find out that a desirable non-blocking ratio is achieved with a filler comprising, in a specific blending ratio, powders of different specific gravities which have specific particle size distributions, in which the powders are thereby uniformly mixed.

It is generally known that the chromite sand (the true specific gravity thereof ranging from 4.4 to 4.6, the bulk specific gravity thereof ranging from 2.7 to 2.9) has about twice as great specific gravities as those of the silica sand (the true specific gravity thereof ranging from 2.2 to 2.3, the bulk specific gravity thereof ranging from 1.4 to 1.6). One of the characteristics of the present invention lies in that, by controlling the silica sand and the chromite sand which have different specific gravities so that the particle diameter of the chromite sand, which has the greater specific gravities, is larger than the diameter of a void defined among particles of the silica sand, which has the smaller specific gravities, the silica sand and the chromite sand are not separated by the difference in the specific gravities and are uniformly mixed.

Accordingly, the present invention provides a filler for a sliding gate containing 70 to 90 wt % of chromite sand and 10 to 30 wt % of silica sand in which the particle size distribution is substantially from 500 to 1,000 $\mu$m.

DESCRIPTION OF THE PREFERRED EMBODIMENTS

Figure 1:
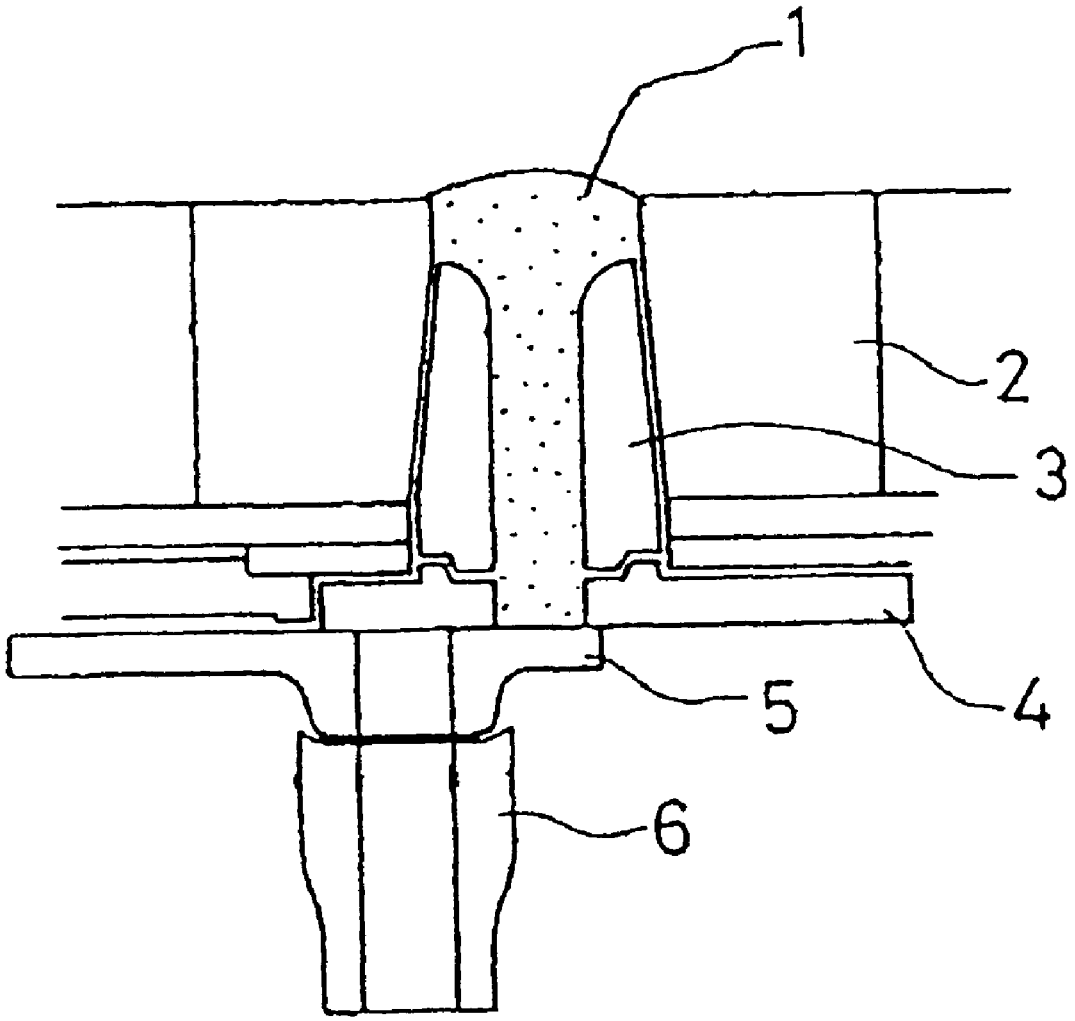
FIG. 1 is a schematic cross section of a sliding gate used in example 5.

The chromite sand used in the present invention is substantially composed of chromite sand having a particle size distribution of 500 to 1,000 $\mu$m, preferably 500 to 800 $\mu$m. The term "substantially" used in this description means that the chromite sand contains 90 wt % or more, preferably 95 wt % or more, of chromite sand particles within the above-mentioned range. The same definition of "substantially" is true of the whole description of this specification. When the particle size of the chromite sand is smaller than 500 $\mu$m, the particle diameter of the chromite sand is smaller than the diameter of a void among particles of the silica sand. Therefore, the more the chromite sand contains particles smaller than 500 $\mu$m in particle size, the less uniformly the chromite sand can be mixed with the silica sand, disadvantageously. Whereas the more the chromite sand contains particles larger than 1,000 $\mu$m in particle size, the lower the filling density becomes, and the molten steel unpreferably penetrates and solidifies in voids and forms a firm sintered layer.

Preferably, the silica sand used in the present invention is substantially composed of silica sand having a particle size distribution of 200 to 500 $\mu$m. The more the silica sand contains particles smaller than 200 $\mu$m in particle size, the lower the fire resistance of the filler drops and the more liable the filler becomes to sinter, disadvantageously. Whereas the more the silica sand contains particles larger than 500 $\mu$m in particle size, the less uniformly the silica sand can be mixed with the chromite sand, unpreferably. The silica sand may contain chemical components such as $Al_2O_3$, $K_2O$ and $Na_2O$. However, since such chemical components lower the melting point of the silica sand, which leads to the blocking, the content thereof is preferably 1 wt % or less.

Further, it is preferable for obtaining a more uniform mixture that the filler for sliding gates according to the present invention comprises chromite sand having a center particle diameter of 500 to 600 $\mu$m and silica sand having a center particle diameter of about 300 $\mu$m. More preferably, each of the chromite sand and the silica sand contains 50 wt % or more particles of the above center particle diameter.

The particle size distribution in the present invention is determined in accordance with the JIS (Japanese Industrial Standard) particle size distribution test of a foundry sand (Z2602). To explain the outline of this test, in the case of the chromite sand, for example, a sieve of nominal mesh size of 1,000 $\mu$m is put on a sieve of nominal mesh size of 500 $\mu$m; the chromite sand is put on the sieve of 1,000 $\mu$m mesh and subjected to a screen classifier such as a low-tap-type screening machine; the chromite sand remaining between the two sieves is regarded as the chromite sand having the particle size distribution of 500 to 1,000 μm in the present invention. The silica sand having the particle size distribution according to the present invention is obtained in the same manner except that the nominal mesh size of the sieves is changed.

The blending ratio of the above chromite sand and silica sand is 70 to 90 wt %, preferably 75 to 85 wt %, and 10 to30 wt %, preferably 15 to 25 wt %, respectively. Through using a filler having a blending ratio within the above range, the non-blocking ratio is improved. That is to say, the possibility that the filler blocks the opening of the sliding gate is diminished.

The chromite sand and silica sand used in the present invention are generally known to exhibit fire resistance up to about 2,150° C. and about 1,720° C. respectively. The fire resistance of the silica sand degrades as its particle diameter becomes smaller. In order to avoid such degradation in fire resistance, it is preferably to use a silica sand having a particle diameter coefficient of 1.4 or less, particularly 1.3 to 1. Also the silica sand having a particle diameter coefficient of 1.4 or less is better in fluidity, less likely to remain in the sliding gate and thus prevents the occurrence of bridging.

The above particle diameter coefficient means a value calculated by using a sand surface area analyzer (manufactured by George Fisher). That is, the particle diameter coefficient is obtained by dividing actual surface area per gram by theoretical surface area. The theoretical surface area is an surface area when all the particles are assumed to be shaped in sphere. Therefore, the closer the particle diameter coefficient is to 1, the nearer to sphere the shape of the particles is.

The chromite sand used in the present invention is not particularly limited, provided that it satisfies the above-mentioned particle size distribution. Natural chromite sand may be used as a material or as it is. Though the components of the chromite sand differ depending on its producing district, the chromite sand generally contains 30 wt % or more, preferably 30 to 60 wt %, of $Cr_2O_3$. Also the silica sand is not particularly limited, provided that it satisfies the above-mentioned particle size distribution. Natural sand may be used as a material or as it is. Though the components of the silica sand differ depending on its producing district, the silica sand generally contains 90 wt % or more $SiO_2$. Examples of the natural sand includes Fremantle sand from Australia. In addition, in order to regulate the quality of the chromite sand and silica sand, they may be subjected to grinding. Of course, ground sand and unground sand may be used as a mixture of two or more.

The grinding may be performed by a conventional dry or wet method.

The dry method includes methods by use of a pneumatic scrubber such as sand reclaimer wherein material sand is blown up with a high-speed air current in the apparatus and thereby is ground by impact and friction of sand particles to one another, a high-speed rotary scrubber wherein material sand is poured on a rapidly rotating rotor and is ground by impact and friction generated between falling sand particles and sand particles projected by centrifugal force, and a high-speed agitator such as an agitation mill wherein sand is ground by fiction of sand particles to one another.

The wet method includes a method by use of a trough-type grinder wherein sand is ground by friction of sand particles to one another in a trough with a rotating blade.

Among these grinding methods, the wet method is preferred; for water used at the grinding can simultaneously wash away sand particles smaller than the desired particle size. However, the sand of the invention may be obtained by the dry method combined with water washing.

The shape of a sliding gate or the kind of molten steel for which the filler for sliding gates according to the present invention is used is not particularly limited. The chromite sand and the silica sand constituting the filler for sliding gates may be separately loaded in a sliding gate because they are capable of being well mixed. However, it is more preferable that they are uniformly mixed prior to being loaded, in view of good workability.

EXAMPLE

The present invention will hereinafter be described in detail by way of examples thereof. These examples, however, are not intended to limit the present invention. In the following examples, each sand has 50% or more of particles of the c-enter particle diameter.

Test Example 1

Chromite sands having different particle size distributions were mixed with a silica sand of a certain particle size distribution to evaluate the uniformity of the mixtures. The uniformity was evaluated as follows: The mixed sands (200 g) were put in a glass container of internal diameter of 5 cm which was 10 cm in height; the container was closed with a lid and shaken 50 times; and then the uniformity in the container was observed with the naked eye. In the "uniformity" column of the following tables, "1" means the mixture is far from being uniform and "10" means that the mixture is uniform. The particle size distribution of each sand shown in Tables 1 and 2 includes that sand particles within the indicated range of size distribution were contained 95 wt % or more (same with the following examples).

TABLE 1

| Chromite Sand | | Silica Sand | | |
|---|---|---|---|---|
| Particle Size Distribution (μm) | Center Particle Diameter (μm) | Particle Size Distribution (μm) | Center Particle Diameter (μm) | Uniformity of Mixture |
| 100 to 300 | about 200 | 200 to 500 | about 300 | 3 |
| 300 to 500 | about 400 | 200 to 500 | about 300 | 4 |
| 500 to 1000 | 500 to 600 | 200 to 500 | about 300 | 10 |

TABLE 2

| Chromite Sand | | Silica Sand | | |
|---|---|---|---|---|
| Particle Size Distribution (μm) | Center Particle Diameter (μm) | Particle Size Distribution (μm) | Center Particle Diameter (μm) | Uniformity of Mixture |
| 100 to 300 | about 200 | 300 to 1000 | 500 to 600 | 1 |
| 300 to 500 | about 400 | 300 to 1000 | 500 to 600 | 3 |
| 500 to 1000 | 500 to 600 | 300 to 1000 | 500 to 600 | 5 |

Tables 1 and 2 show that, by using a chromite sand and a silica sand which have particle size distributions of the present invention, a uniform mixture can be obtained.

Test Example 2

A chromite sand having the particle size distribution of 500 to 1,000 μm (having the center particle diameter of 500 to 600 μm) and silica sands having the particle size distribution of 200 to 500 μm (having the center particle diameter of about 300 μm) and varied particle diameter coefficients were used to evaluate the uniformity of the mixtures. The evaluation was made in the same manner as in Example 1.

TABLE 3

| Particle Diameter Coefficient of the Silica Sand | Uniformity of Mixture |
|---|---|
| 1.7 | 6 |
| 1.6 | 7 |
| 1.5 | 9 |
| 1.4 | 10 |
| 1.3 | 10 |
| 1.2 | 10 |

Table 3 shows that the preferable uniformity of mixture can be obtained when the particle diameter coefficient of the silica sand is less than 1.4.

Examples 1 to 3 and Comparative Examples 1 and 2.

In these examples and comparative examples, chromite sands and silica sands having different particle size distributions, center particle diameters and particle diameter coefficients were used to obtain various fillers for sliding gates as shown in Table 4, provided that the mixture ratio of the chromite and silica sands is always 8:2 (by weight) in common.

TABLE 4

| | Particle Size Distribution (μm) | Center Particle Diameter (μm) | Particle Size Distribution (μm) | Center Particle Diameter (μm) | Uniformity of Mixture |
|---|---|---|---|---|---|
| Ex. 1 | 500 to 1000 | 500 to 600 | 200 to 500 | about 300 | 1.25 |
| Ex. 2 | 500 to 1000 | 500 to 600 | 200 to 500 | about 300 | 1.3 |
| Ex. 3 | 500 to 1000 | 500 to 600 | 200 to 500 | about 300 | 1.5 |
| Com. Ex. 1 | 100 to 300 | about 200 | 300 to 1000 | 500 to 600 | 1.6 |
| Com. Ex. 2 | 500 to 1000 | 500 to 600 | 300 to 1000 | 500 to 600 | 1.5 |

The fillers for sliding gates described in Table 4 (each 60 kg) were filled in a sliding gate (of internal diameter of 75 mm) provided at the bottom of a ladle of 250t, and the non-blocking ratio was determined on 500 charges in each of which molten steel at 1,600 to 1,650° C. was held in the ladle for 2 to 5 hours. The results were shown in Table 5.

TABLE 5

| | Non-blocking Ratio (%) |
|---|---|
| Ex.1 | 100 |
| Ex.2 | 100 |
| Ex.3 | 99.0 |
| Com. Ex.1 | 98.8 |
| Com. Ex.2 | 99.2 |

As clearly shown in Table 5, the fillers for sliding gates according to the present invention are able to improve the non-blocking ratio. Further, the fillers wherein the silica sand has the particle diameter coefficient of 1.4 or less (Examples 1 and 2) are able to improve the non-blocking ratio more than the fillers wherein the silica sand has a particle diameter coefficient of more than 1.4 (Example 3). The non-blocking ratio is an important factor affecting producing costs and safety in steel works. For example, in these present examples, a 1% reduction in the non-blocking ratio means that the blocking occurs 5 times. This is a serious problem to safe operations. The filler for sliding gates of the present invention can solve this problem.

Example 4

Fillers were obtained in the same manner as in Example 1 except that the mixture ratio (by weight) of the chromite sand and silica sand is varied in order to determine the non-blocking ratio of the fillers. The results are shown in Table 6.

TABLE 6

| Mixture Ratio (wt %) | | Non-Blocking |
|---|---|---|
| Chromite Sand | Silica Sand | Ratio |
| 0 | 100 | 98.4 |
| 50 | 50 | 98.8 |
| 60 | 40 | 99.4 |
| 70 | 30 | 100 |
| 80 | 20 | 100 |
| 90 | 10 | 100 |
| 100 | 0 | 99.2 |

Since the specific gravity of the chromite sand is about 2 times as large as that of the silica sand, the above mixture ratio, when the chromite sand: the silica sand is 70%:30% by weight, comes to 7:6 in terms of volume ratio. The volume of the chromite sand is a little larger than that of the silica sand. In this case, the non-blocking ratio is 100%. When the mixture ratio of the chromite sand: the silica sand is 60%:40% by weight, the volume ratio comes to 6:8. The volume of the chromite sand is a little smaller than that of the silica sand. In this case, the non-blocking ratio is 99.4%.

When the filler is composed of 100% of the chromite sand, the non-blocking ratio becomes worse, 99.2%.

Therefore, it is recognized that fillers for sliding gates containing 70 to 90 wt % of the chromite sand and 10 to 30 wt % of the silica sand are most preferable in view of improving the non-blocking ratio.

Example 5

In a certain steel works, a filler for sliding gates containing a chromite sand (80 wt %) having the particle distribution of 500 to 1,000 μm (the center particle diameter being 500 to 600 μm) and a silica sand (20 wt %) having the particle distribution of 200 to 500 μm (the center particle diameter being about 300 μm) was fed to a height of 380 mm in each sliding gate of four 250-ton ladles for steel manufacture. FIG. 1 is a schematic cross sectional view of the sliding gate used in this example. In FIG. 1, the reference numerals 1, 2, 3, 4, 5 and 6 denote a filler for sliding gates, a gate seating block, an upper gate, a fixed plate, a sliding plate and a lower gate. Then, steel was made of stainless steel with a low carbon content, a low nitrogen content and a high chrome con tent under the conditions of a melting temperature of 1,720 to 1,780° C. and a molten state time of 4 to 7 hours.

Subsequently, when the lower gate 6 was sided to allow the molten steel to be poured into a casting mold, the filler 1 was discharged and fall and immediately the molten steel flew out. This operation was repeated 1,000 times without any blocking generated.

As described above, the filler for sliding gates of the present invention is characterized by containing 70 to 90 wt % of chromite sand and 10 to 30 wt % of silica sand in which the particle size distribution of the chromite sand is substantially from 500 to 1,000 μm.

Thus, according to the present invention, it is possible to obtain a filler for sliding gates wherein the chromite sand and silica sand, whose specific gravities are different, can be uniformly mixed. Thereby, when the filler is filled in a sliding gate, the filler can stably maintain the suitable mixing ratio which does not allow blocking.

In addition, in the filler of the present invention, when the silica sand has the particle diameter coefficient of 1.4 or less, the fire resistance of the silica sand can be improved and the occurrence of bridging can be inhibited.

What is claimed is:

1. A filler for a sliding gate containing 70 to 90 wt % of chromite sand having a particle size distribution substantially from 500 to 1,000 μm and 10 to 30% of silica sand having a particle diameter coefficient of 1.4 or less.

2. A filler according to claim 1 in which the silica sand has a particle size distribution substantially from 200 to 500 μm.

3. A filler according to claim 1 in which the chromite sand has a center particle diameter of 500 to 600 μm and the silica sand has a center particle diameter of about 300 μm.

4. A filler according to claim 2, in which the chromite sand has a center particle diameter of 500 to 600 μm and the silica sand has a center particle diameter of about 300 μm.

5. A filler for a sliding gate containing 10 to 30 wt % of silica sand having a particle diameter coefficient of 1.4 or less and 70 to 90 wt % of chromite sand.

* * * * *